US009120644B2

(12) United States Patent
Piech et al.

(10) Patent No.: US 9,120,644 B2
(45) Date of Patent: Sep. 1, 2015

(54) BRAKING DEVICE

(75) Inventors: Zbigniew Piech, Cheshire, CT (US); Benjamin J. Watson, Burlington, CT (US)

(73) Assignee: Otis Elevator Company, Farmington, CT (US)

( * ) Notice: Subject to any disclaimer, the term of this patent is extended or adjusted under 35 U.S.C. 154(b) by 590 days.

(21) Appl. No.: 13/640,081

(22) PCT Filed: May 21, 2010

(86) PCT No.: PCT/US2010/035814

§ 371 (c)(1), (2), (4) Date: Oct. 9, 2012

(87) PCT Pub. No.: WO2011/146075

PCT Pub. Date: Nov. 24, 2011

(65) Prior Publication Data

US 2013/0025974 A1 Jan. 31, 2013

(51) Int. Cl.
*B66B 1/32* (2006.01)

(52) U.S. Cl.
CPC ..... *B66B 1/32* (2013.01)

(58) Field of Classification Search
CPC ..... B66B 1/30; B66B 1/32
USPC ..... 187/247, 288, 289, 290, 391, 393; 318/362–372, 375, 376
See application file for complete search history.

(56) References Cited

U.S. PATENT DOCUMENTS 3,741,348 A * 6/1973 Caputo ..... 187/284
3,830,344 A * 8/1974 Cervenec et al. ..... 188/171
3,961,688 A * 6/1976 Maynard ..... 187/289
5,070,290 A * 12/1991 Iwasa et al. ..... 318/758
5,276,292 A * 1/1994 Goto et al. ..... 187/288
5,327,055 A * 7/1994 Danielson et al. ..... 318/366
5,698,823 A * 12/1997 Tanahashi ..... 187/296
7,456,594 B2 11/2008 Potter et al.
8,631,908 B2 * 1/2014 Schroeder-Brumloop et al. ..... 187/290
8,869,945 B2 * 10/2014 Harkonen et al. ..... 187/288
8,890,448 B2 * 11/2014 Putkinen et al. ..... 318/371

(Continued)

FOREIGN PATENT DOCUMENTS

CN 101056813 A 10/2007
CN 101522552 A 9/2009

(Continued)

OTHER PUBLICATIONS

Japanese Office Action, Application No. 2013-511138 dated on Feb. 19, 2014.

(Continued)

*Primary Examiner* — Anthony Salata
(74) *Attorney, Agent, or Firm* — Miller, Matthias & Hull LLP

(57) ABSTRACT

A braking device for an elevator is disclosed. The device may include a motor, a braking system, a first switch, and a second switch. The motor may be capable of generating a counter-electromotive force. The braking system may move to a disengaged position upon being energized and may move to an engaged position upon being de-energized. The first and second switches may have an open state. In the open state, the switches electrically couple the motor to the braking system so that the counter-electromotive force of the motor may energize the braking system.

20 Claims, 5 Drawing Sheets

(56) References Cited

U.S. PATENT DOCUMENTS

| | | | | |
|---|---|---|---|---|
| 2010/0038185 | A1 | 2/2010 | Kattainen | |
| 2010/0051391 | A1 | 3/2010 | Jahkonen | |
| 2013/0313052 | A1* | 11/2013 | Della Porta | 187/288 |
| 2015/0136530 | A1* | 5/2015 | Rui et al. | 187/288 |
| 2015/0191327 | A1* | 7/2015 | Rogers et al. | 187/276 |

FOREIGN PATENT DOCUMENTS

| | | | |
|---|---|---|---|
| CN | 101588979 | A | 11/2009 |
| JP | 04182290 | | 6/1992 |
| JP | 2008056428 | A | 3/2008 |
| JP | 2009263109 | A | 11/2009 |
| JP | 2009298582 | A | 12/2009 |
| WO | WO 2009-075669 | A1 | 6/2009 |

OTHER PUBLICATIONS

Chinese Office Action, Application No. 201080066901.0 dated on May 19, 2014.

* cited by examiner

BRAKING DEVICE

CROSS-REFERENCE TO RELATED APPLICATIONS

This application is a U.S. national stage filing under 35 USC §371 of International Patent Application No. PCT/US2010/0035814, filed on May 21, 2010.

FIELD OF THE DISCLOSURE

The present disclosure generally relates to braking devices, and, in particular, relates to a braking device for use with elevators.

BACKGROUND OF THE DISCLOSURE

In modern society, elevators have become ubiquitous machines for transporting people and cargo through buildings of multiple stories. As elevators are operated continually throughout the day making frequent stops at various floor levels, the braking system of an elevator plays an important role in the smooth operation of the elevator.

Gearless machines such as elevators or other belt-driven systems typically employ a mechanical or electromechanical braking system to stop or temporarily hold a particular motion. Electromechanical brakes of elevators, for instance, generally employ a clutch-type braking mechanism for supplying a holding or braking torque that is sufficient for slowing or holding an elevator car at a fixed position. The braking torque supplied by clutch-type brakes is mechanically produced by the friction that is generated between a rotating brake disk that is rigidly attached to a machine shaft and a set of friction pads that is releasably placed in contact with a surface of the brake disk. The engagement or disengagement of the friction pads is electromechanically controlled by a brake coil. Moreover, when the brake coil is activated, a magnetic attraction between the armature plates and an electromagnetic core causes the friction pads to disengage from the surface of the brake disk. When the brake coil is deactivated, springs that engage the armature plates urge the armature plates into engagement with the surface of the brake disk. Although such clutch-type brakes have been proven to be effective and are still widely used today in various gearless applications such as elevators, and the like, they still have room for improvement.

For instance, the range of braking torque that a specific clutch-type brake can variably apply is relatively narrow. For example, a clutch-type brake cannot provide a different stopping power in certain situations (e.g. emergency stops, or the like) than in other situations (e.g. normal stops, or the like). During an emergency, such as loss of power to the building, an elevator must be able to perform an emergency stop. An emergency stop can be abrupt, causing the elevator car to jerk, which can be an uncomfortable experience for passengers traveling within the elevator car. Emergency stops also wear down the braking system. Furthermore, the braking system installed to handle such emergency stops must be bulky and expensive.

Conversely, a clutch-type brake cannot provide reduced stopping power for normal stops than with emergency stops. A typical clutch-type brake is limited to its rated torque which is further dictated by the invariable mechanical limits of the brake, material composition of its friction pads, and the like. Therefore, in normal operation, an elevator equipped with a bulky heavy duty braking system will provide the same braking torque for a normal stop than it would with an emergency stop. Thus, the elevator car, as well as the passengers within it, may experience a jerk every time the braking system is engaged to stop the elevator. Accordingly, it follows that clutch-type brakes do not offer control or variation of the braking torque.

In light of the foregoing, improvements continue to be sought for smoothly stopping an elevator with minimal strain on the system.

SUMMARY OF THE DISCLOSURE

In accordance with one aspect of the disclosure, a braking device for an elevator is disclosed. The device may include a motor, a braking system, a first switch, and a second switch. The motor may be capable of generating a counter-electromotive force. The braking system may move to a disengaged position upon being energized and may move to an engaged position upon being de-energized. The first and second switches may have an open state. In the open state, the switches electrically couple the motor to the braking system so that the counter-electromotive force of the motor may energize the braking system.

In accordance with another aspect of the disclosure, an elevator with a braking device is disclosed. The elevator may include an elevator car, a motor, a braking system operatively coupled to the motor, a tension member operatively coupled to the motor and the elevator car, and an electronic controller. The motor may be capable of generating a counter-electromotive force. The motor may be free to rotate when the braking system may be in a disengaged position and may be prohibited from rotating when the braking system may be in an engaged position. The braking system may move to the disengaged position upon being energized and may move to the engaged position upon being de-energized. When the motor starts to rotate, the tension member may move the elevator car. The electronic controller may include first and second switches having an open state. In the open state, the first and second switches may electrically couple the motor to the braking system so that the counter-electromotive force of the motor may energize the braking system.

In accordance with yet another aspect of the disclosure, a method for controlled stopping of an elevator is disclosed. The method may include providing a motor capable of generating a counter-electromotive force; providing a braking system having a disengaged and an engaged position, wherein the braking system moves to the disengaged position upon being energized and moves to the engaged position upon being de-energized; electrically coupling the motor to the braking system; creating a braking torque for the elevator from the counter-electromotive force of the motor; energizing the braking system with the counter-electromotive force of the motor; and releasing the braking system to the engaged position as the counter-electromotive force dissipates into the braking torque for the elevator.

These and other aspects of this disclosure will become more readily apparent upon reading the following detailed description when taken in conjunction with the accompanying drawings.

Figure 1:
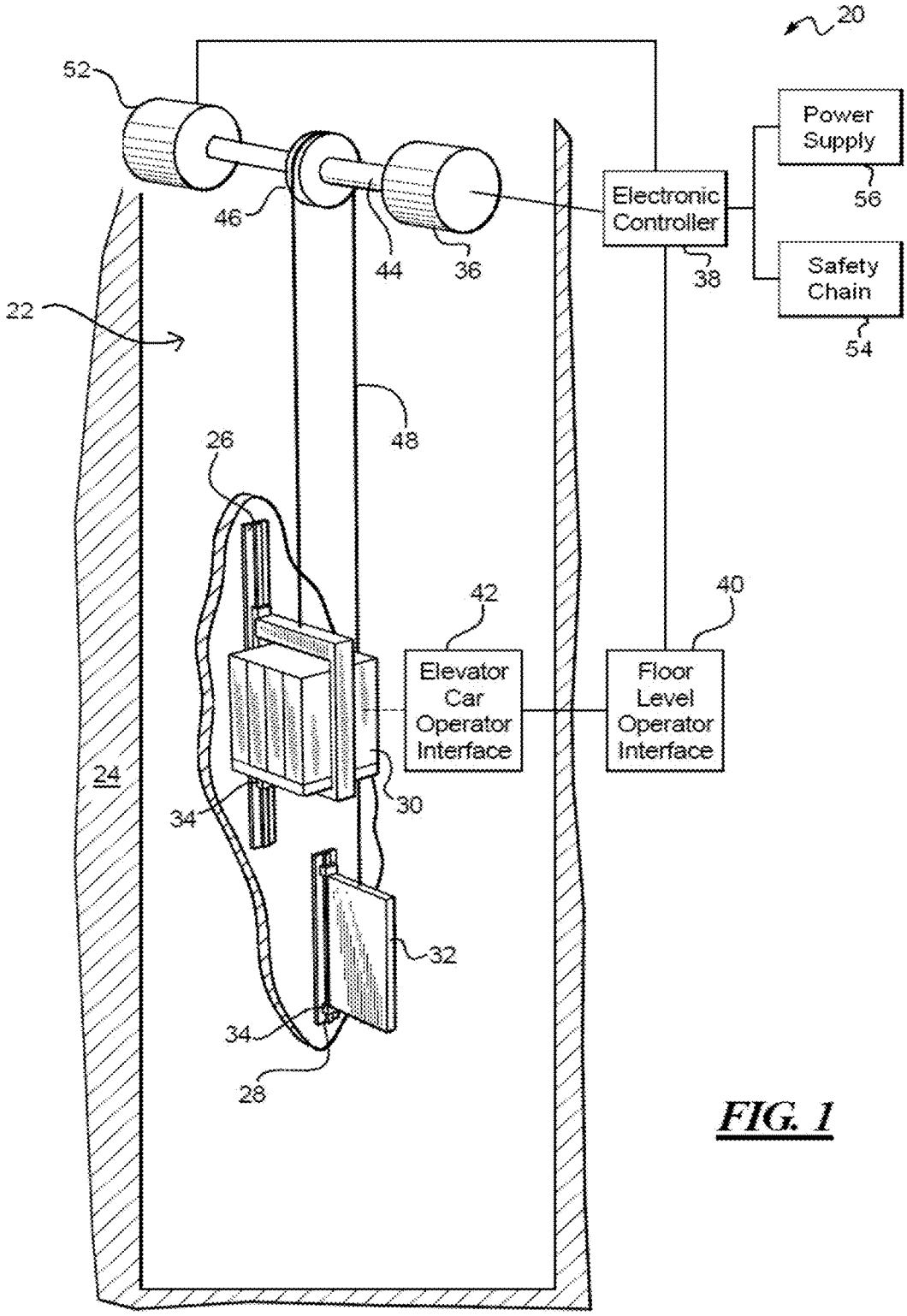
FIG. 1 is an embodiment of an elevator constructed in accordance with the teachings of the disclosure.

While the present disclosure is susceptible to various modifications and alternative constructions, certain illustrative embodiments thereof have been shown in the drawings and will be described below in detail. It should be understood, however, that there is no intention to be limited to the specific forms disclosed, but on the contrary, the intention is to cover all modifications, alternative constructions, and equivalents falling within the spirit and scope of the present disclosure.

DETAILED DESCRIPTION OF THE DISCLOSURE

Referring now to FIG. 1, an elevator system 20 is shown in schematic fashion. It is to be understood that the version of the elevator 20 shown in FIG. 1 is for illustrative purposes only and to present background for the various components of a general elevator system.

As shown in FIG. 1, the elevator system 20 may include a hoistway 22 provided vertically within a multi-story building 24. Typically, the hoistway 22 could be a hollow shaft provided within a central portion of the building 24 with multiple hoistways being provided if the building is of sufficient size and includes multiple elevators. Extending substantially the length of the hoistway 22 may be rails 26 and 28. An elevator car 30 may be slidably mounted on a pair of rails 26 (only one rail 26 shown in FIG. 1 for clarity) and a counterweight 32 may be slidably mounted on a pair of rails 28 (only one rail 28 shown in FIG. 1 for clarity). While not depicted in detail in FIG. 1, one of ordinary skill in the art will understand that both the car 30 and counterweight 32 could include roller mounts 34, bearings, or the like for smooth motion along the rails 26 and 28. The roller mounts, bearings, or the like may also be slidably mounted to the rails 26 and 28 in a secure fashion.

In order to move the car 30 and thus the passengers and/or cargo loaded thereon, a motor 36 may be provided typically at the top of hoistway 22. Electrically coupled to the motor 36 may be an electronic controller 38 which in turn may be electrically coupled to a plurality of operator interfaces 40 provided on each floor to call the elevator car 30, as well as operator interfaces 42 provided on each car 30 to allow the passengers thereof to dictate the direction of the car 30. A safety chain circuit 54, as well as a power supply 56, may also be electrically coupled to the electronic controller 38. Mechanically extending from the motor 36 may be a drive shaft 44, which in turn may be operatively coupled to a traction sheave 46, and further may extend to operatively couple to a braking system 52. The braking system 52 may also be electrically coupled to the electronic controller 38. Trained around the sheave 46 may be a tension member 48, such as a round rope or a flat belt. The tension member 48 may be in turn operatively coupled to counterweight 32 and car 30 in any suitable roping arrangement. Of course, multiple different embodiments or arrangements of these components are possible with a typical system including multiple tension members 48 as well as various arrangements for the motor and the sheaves of the elevator system 20.

Figure 2:
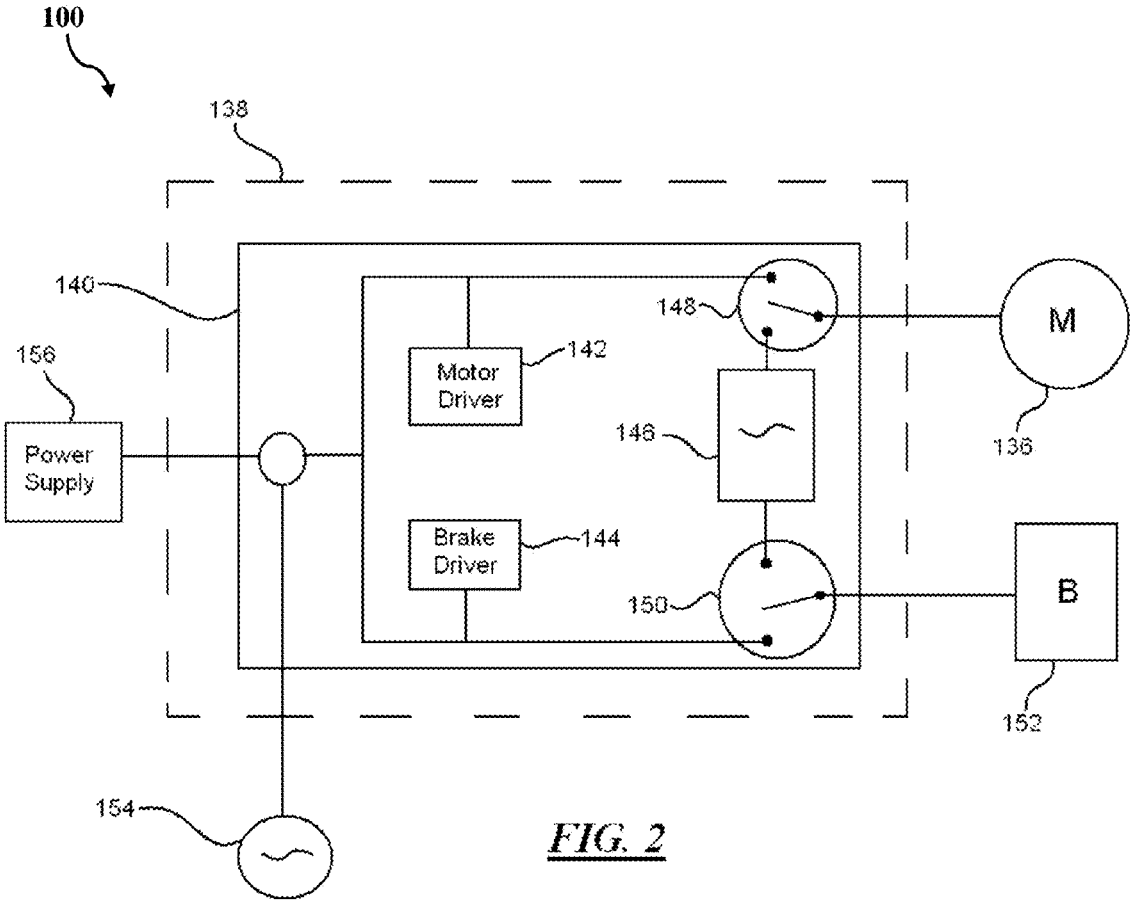
FIG. 2 is an embodiment of a braking device for an elevator constructed in accordance with the teachings of the disclosure.

In FIG. 2, a braking device 140 is disclosed, which may be designed within the electronic controller 138. It should be understood that the device 140 does not have to be designed within the electronic controller 138, and that it may be designed as a free-standing circuit on its own or incorporated within any other component within the elevator 20. The braking device 140 may include a motor driver 142, a brake driver 144, a signal convertor 146, a first switch 148, and a second switch 150. The first and second switches 148, 150 may have a closed state and an open state. The motor 136 and the braking system 152 may be electrically coupled to the device 140 such that when the switches (148, 150) are in the closed state, the motor driver 142 may energize the motor 136, and the brake driver 144 may energize the braking system 152. The power supply 156 and the safety chain 154 may also be electrically coupled to the device 140.

The power supply 156 may energize the safety chain 154, the motor driver 142, brake driver 144, first switch 148, and second switch 150. It should be understood that the power supply 156 may energize other components within the elevator 20 such as, but not limited to, the electronic controller 138 and the operator interfaces 40, 42. Furthermore, the power supply 156 may provide an alternating current (AC) power source or a direct current (DC) power source, depending on the power needs of the components being energized. Moreover, the elevator 20 may incorporate more than one power supply to energize the various components within the system 20. For example, one power supply may energize the motor driver 142, while another power supply may energize the brake driver 144.

The safety chain 154 may be a separate circuit with a discrete number of switches designed to indicate the status of the doors and the position of the elevator 20. In addition, there may be a number of other switches designed to monitor the safety status of the other elevator 20 components. These switches may be wired together in a serial circuit. If one of the switches is not closed, then this circuit may be considered "open", and the elevator 20 shall not operate.

In the event the elevator 20 experiences a power loss, i.e. power supply 156 failure, or the safety chain 154 indicates a malfunction in the system 20, i.e. the circuit 154 is "open", the elevator may go into an emergency mode. In the emergency mode, the elevator 20 should smoothly and safely stop the elevator car 30. In order to perform such a task, the braking device 140 may detect a power loss from the power supply 156 or malfunction from the safety chain 154, and transition the first and second switches 148, 150 from the closed state to the open state. In the open state, the first and second switches 148, 150 electrically couple the motor 136 to the braking system 152. The signal convertor 146 may be designed in between the motor 136 and the braking system 152 to aid in converting a signal from the motor 136 to an acceptable format to be received by the braking system 152.

In one exemplary embodiment, the motor 136 may generate a counter-electromotive force, i.e. counter EMF, also known as back EMF. As voltage may be supplied to rotate the motor 136, a counter EMF may be generated by the motor 136 to oppose the induced current in the motor 136. The value of the counter EMF may be determined by the speed of rotation (RPM) of the motor 136, such that as the RPM of the motor 136 increases or decreases, so does the counter EMF, respectfully. As long as the counter EMF of the motor 136 may be weaker than the supplied voltage by the motor driver 142, the motor 136 may be driven. Once the elevator 20 experiences an emergency mode, the first and second switches 148, 150 may transition to the open state, the motor 136 may then be decoupled from the motor driver 142 and may be electrically coupled to the braking system 152. At this point the supplied voltage to the motor 136, which should be zero due to the motor driver 142 being decoupled, will be less than the generated counter EMF, and the motor 136 may act as a generator to the braking system 152 by energizing the braking system 152 with the counter EMF. At the same time, the counter EMF may provide a braking torque to the elevator 20. The mechanical load of the drive shaft 44, traction sheave 46, tension member 48, and elevator car 30 on the motor 136 may dissipate the counter EMF as the RPM of the motor 136 reduces while being used as a braking torque to smoothly slow down the elevator car 30. As the counter EMF dissipates into the braking torque for the elevator 20, the braking system 152 may no longer be energized by the motor 136. Once the braking system 152 is de-energized, the braking system 152 may engage and frictionally stop the elevator car 30. The combination of the braking torque provided by the counter EMF and the frictional engagement of the braking system 152 may provide a controlled emergency stop for the elevator 20.

Figure 3:
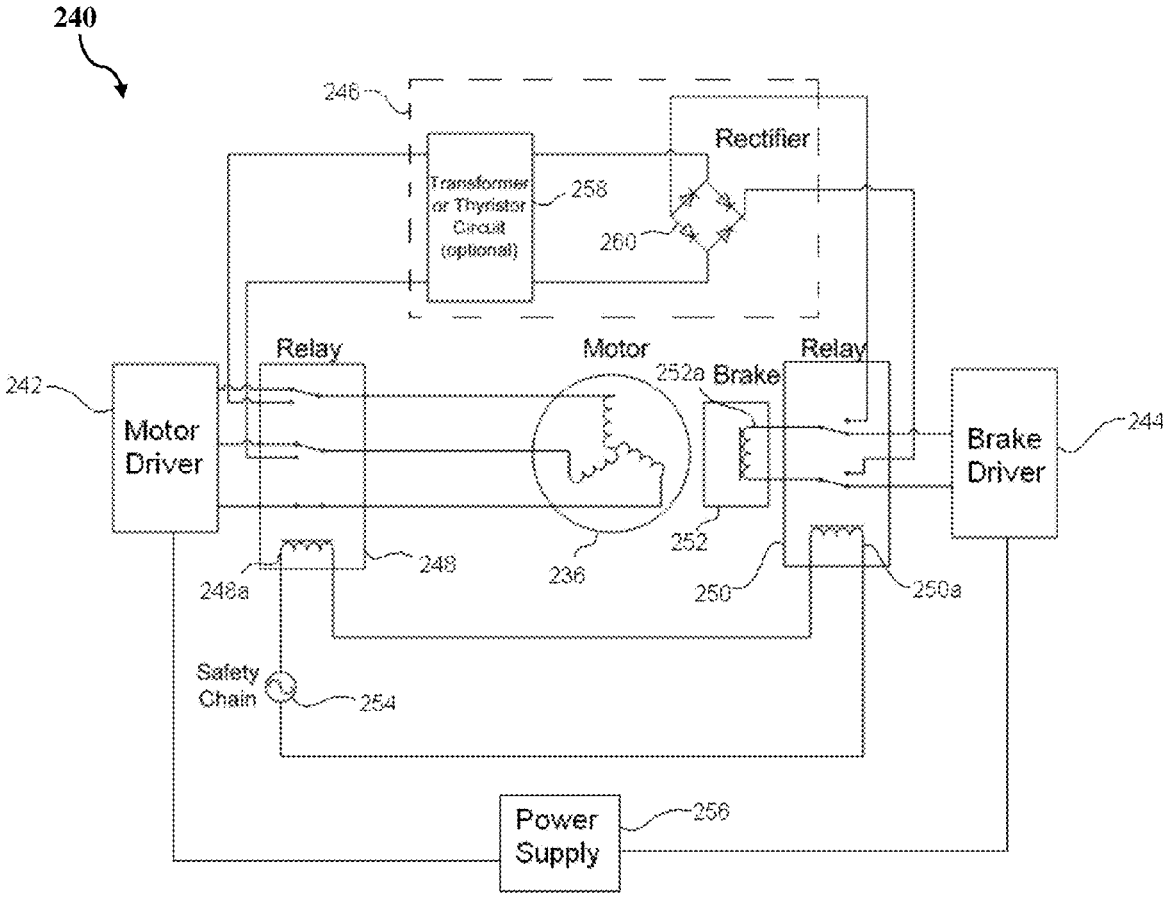
FIG. 3 is another embodiment of a braking device depicted in a normal mode.
Figure 4:
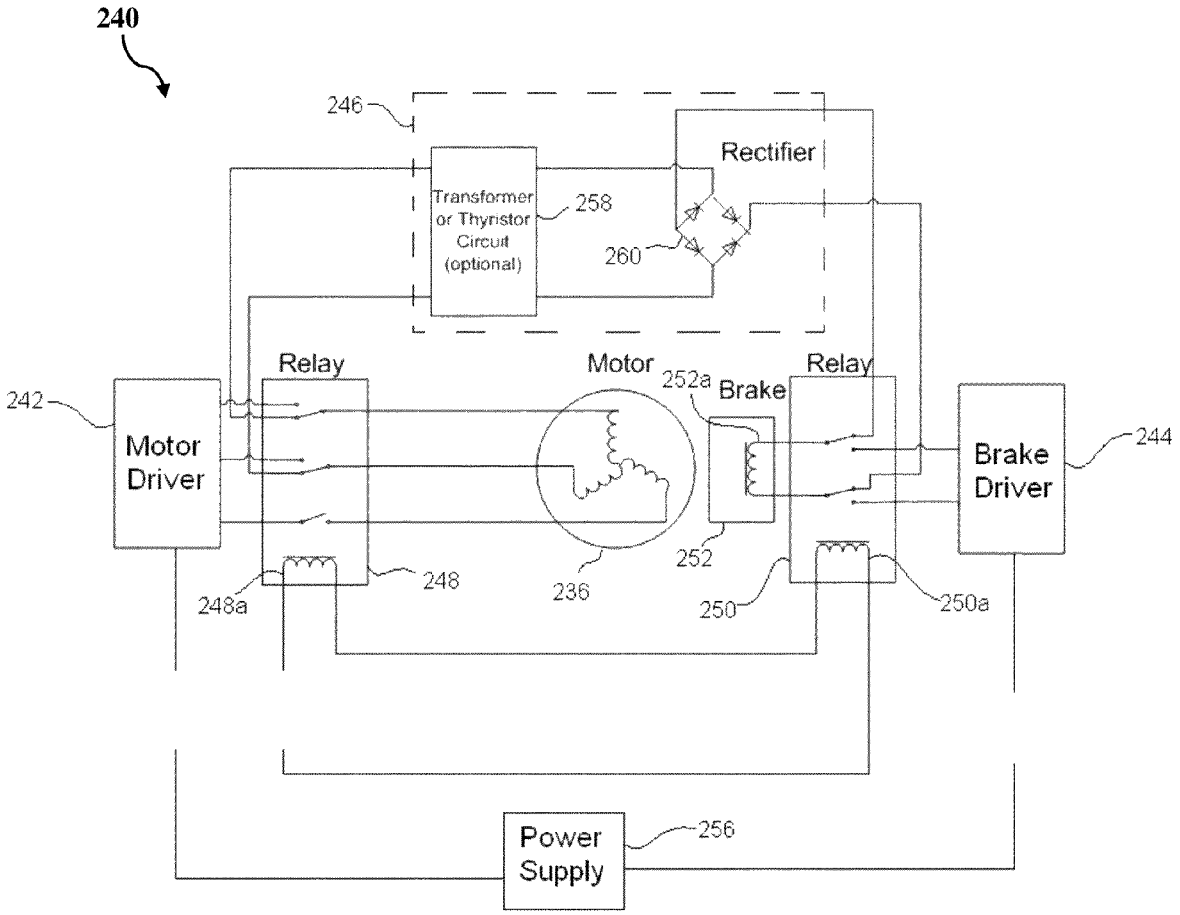
FIG. 4 is the device of FIG. 3 depicted in an emergency mode.

Referring now to FIGS. 3 and 4, another embodiment of a braking device 240 is disclosed. FIG. 4 illustrates the device 240 in normal operation, and FIG. 3 illustrates the device 240 during an emergency mode. The braking device 240 may include a motor driver 242, a brake driver 244, a signal convertor 246, a first switch 248, and a second switch 250. The first and second switches 248, 250 may be an electromagnetic relay. The electromagnetic relays 248, 250 may utilize a coil 248*a*, 250*a*, which may be energized and de-energized in order to switch contacts from one state to another. It should be understood that first and second switches 248, 250 may be any other type of switch, besides a relay, such as, but not limited to, a logic device, a sensor, or any other device capable of transitioning from one state to another. The signal convertor 246 may include a transformer 258 and a rectifier 260. The transformer 258 may provide a method for stepping down the voltage, while the rectifier 260 may convert an AC voltage supply to a DC voltage supply. It should be understood that the transformer 258 and the rectifier 260 may be capable of performing other electrical functions as known in the art. Moreover, the signal convertor 246 may include other electrical components and/or circuits necessary to convert a signal from one format being inputted to a desired format being outputted.

A motor 236, braking system 252, power supply 256, and safety chain 254 may be electrically coupled to the braking device 240. The safety chain 254 may signal to the device 240 that a malfunction has occurred in the elevator 20 upon one of its switches opening. The power supply 256 may energize the motor driver 242, brake driver 244, relays 248, 250, safety chain 254, and any other component within the elevator 20 requiring power. It should be understood that the power supply 256 may be an AC or DC supply. Furthermore, the elevator 20 may incorporate multiple power supplies to energize its components. Moreover, the motor driver 242 and brake driver 244 may be capable of converting AC-to-DC and vice-versa in order to energize the motor 236 and braking system 252, respectfully.

The motor 236 may be a permanent magnetic motor such as, but not limited to, an AC or DC brushless motor. Furthermore, the motor 236 may be a three-phase motor with three terminals. The motor 236 may be capable of generating a counter EMF. In a permanent magnet motor, a coil of wire called an armature may be arranged in the magnetic field of a permanent magnet in such a way that it rotates when a current may be passed through it. The current may cause the armature to rotate, which in turn may generate a voltage opposing the applied voltage. The induced voltage created by the rotation of the armature may be referred to as the counter EMF generated by the motor 236. The braking system 252 may be an electromechanical braking system, which may include one or more brake coils 252*a*. Upon energizing the braking system 252, the brake coil 252*a* will disengage the braking system 252 via magnetic attraction. Once the brake coil 252*a* is no longer energized, the braking system 252 may engage.

As depicted in FIG. 3, in normal mode, the power supply 256 may energize the relays 248, 250 to be in a closed state, so that the motor driver 242 and brake driver 244 may energize the motor 236 and braking system 252, respectfully. In the event of an emergency, as depicted in FIG. 4, the relays 248, 250 may transition to an open state, wherein two terminals of the motor 236 may be electrically coupled to the braking system 252 with the signal convertor 246 in between. An emergency may occur when the power supply 256 no longer energizes the system 20, or the safety chain 254 detects a malfunction in the system 20. Once the safety chain 254 opens due to a malfunction in the system 20, the relays 248, 250 may no longer be energized, and thus transition to the open state.

Figure 5:
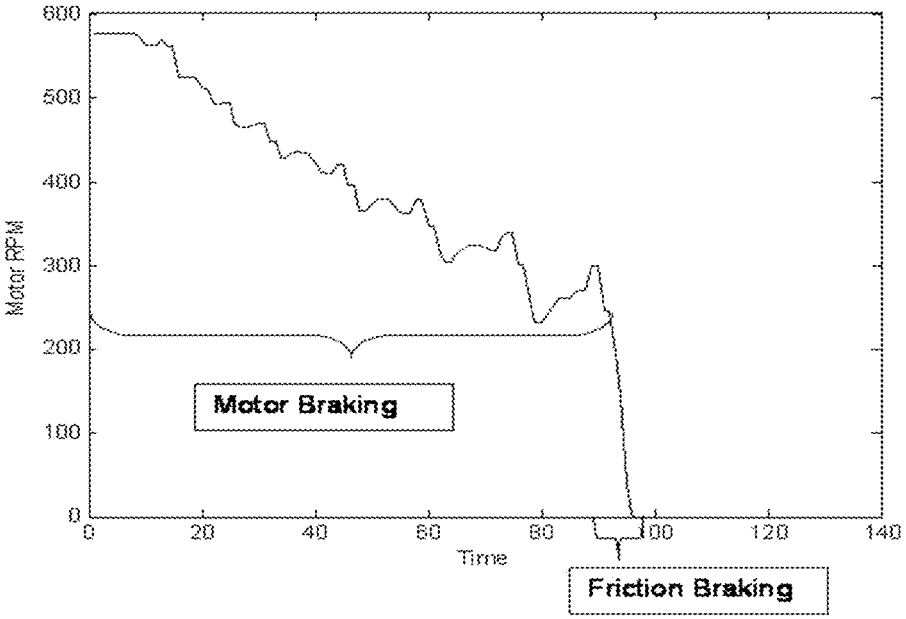
FIG. 5 is a graphical representation of a motor decelerating when applying a braking torque to the elevator and the engagement of a braking system during the emergency mode.
Figure 6:
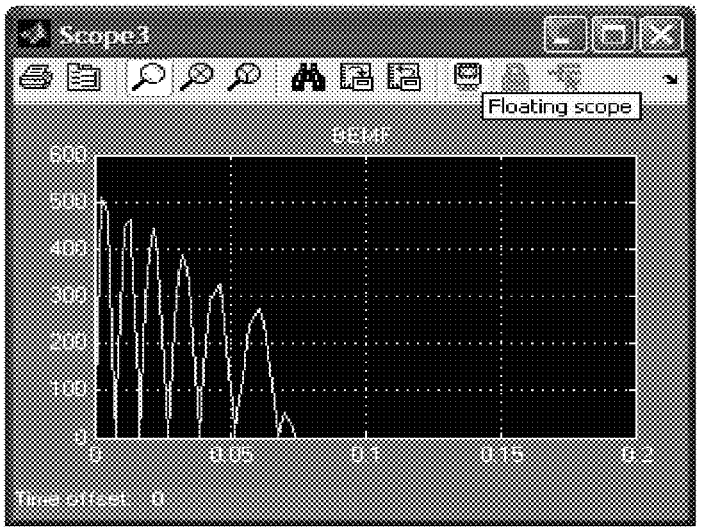
FIG. 6 is a graphical representation of counter-electromotive force of the motor dissipating during the emergency mode.

Once the motor 236 is electrically coupled to the braking system 252, the counter EMF of the motor 236 may act as a braking torque for the elevator 20 until the braking system 252 may engage to frictionally stop the elevator car 30, as depicted in FIG. 5. When the motor 236 is electrically coupled to the braking system 252, the counter EMF of the motor 236 may energize the brake coil 252*a* to keep the braking system 252 disengaged. Concurrently, the counter EMF may provide a braking torque to the elevator 20. As the counter EMF starts to dissipate, as depicted in FIG. 6, from being used as a braking torque to slow down the elevator car 30, the counter EMF may become too weak to continue to energize the brake coil 252*a*, upon which the braking system 252 may engage and frictionally stop the elevator car 30.

In light of the foregoing, it can be seen that the present disclosure sets forth a braking device for an elevator. Elevators are continually used to transport passengers from one level to the next, making frequent stops. A braking system of the elevator may be relied upon to ensure that an elevator car comes to a smooth and frictional stop, especially in the event of an emergency. Emergencies may occur when the elevator experiences a power loss or a malfunction. In the event of an emergency, the braking device may ensure that the elevator is brought to a smooth and frictional stop. The braking device may provide for counter EMF generated by a motor to energize the braking system to remain in a disengaged position. The counter EMF may concurrently provide a braking torque for the elevator. Once the counter EMF has dissipated by being used as braking torque for the elevator, it no longer can energize the braking system. The braking system, at this point, may engage to frictionally stop the elevator car. The combination of the braking torque provided by the counter EMF and the frictional engagement of the braking system may provide a brake for the elevator.

While only certain embodiments have been set forth, alternatives and modifications will be apparent from the above description to those skilled in the art. These and other alternatives are considered equivalents and within the spirit and scope of this disclosure.

What is claimed is:

1. A braking device for an elevator, comprising:

a motor capable of generating a counter-electromotive force;

a braking system having a disengaged and an engaged position, wherein the braking system moves to the disengaged position upon being energized and moves to the engaged position upon being de-energized; and first and second switches having an open state, wherein in the open state, the first and second switches electrically couple the motor to the braking system, enabling the counter-electromotive force of the motor to energize the braking system.

2. The device of claim 1, further includes a motor driver capable of energizing the motor, and a brake driver capable of energizing the braking system.

3. The device of claim 2, wherein the first and second switches further include a closed state, wherein in the closed state, the first switch enables the motor driver to energize the motor and the second switch enables the brake driver to energize the braking system.

4. The device of claim 2, wherein the motor driver, the brake driver, the first switch, and the second switch are energized by a power supply.

5. The device of claim 1, wherein the motor is a permanent magnet motor.

6. The device of claim 1, wherein the braking system is an electromechanical braking system.

7. The device of claim 6, wherein the electromechanical braking system includes a brake coil, the brake coil disengages the braking system upon being energized and engages the braking system upon being deenergized.

8. The device of claim 1, wherein the first and second switches are electrically coupled to a power supply, whereupon the power supply deenergizes the first and second switches causes the first and second switches to transition into the open state.

9. The device of claim 1, wherein the first and second switches are electrically coupled to a safety chain, whereupon the safety chain signaling a malfunction mode to the first and second switches causes the first and second switches to transition into the open state.

10. The device of claim 1, wherein in the open state, the motor is electrically coupled to the braking system with a signal converter in between, the signal converter is capable of converting the counter-electromotive force of the motor to be in an acceptable format to be received by the braking system.

11. The device of claim 10, wherein the signal converter includes a transformer and a rectifier.

12. An elevator with a braking device, comprising:

an elevator car;

a motor associated with the elevator and capable of generating a counter-electromotive force;

a braking system operatively coupled to the motor and having a disengaged and an engaged position, wherein the disengaged position the motor is free to rotate and in the engaged position the motor is prohibited from rotating, the braking system moves to the disengaged position upon being energized and moves to the engaged position upon being de-energized;

a tension member operatively coupled to the motor and the elevator car, whereupon rotating the motor moves the elevator car; and an electronic controller, including first and second switches having an open state, wherein in the open state, the first and second switches electrically couple the motor to the braking system, enabling the counter-electromotive force of the motor to energize the braking system.

13. The elevator of claim 12, wherein the electronic controller further includes a motor driver capable of energizing the motor, and a brake driver capable of energizing the braking system.

14. The elevator of claim 13, further includes a power supply electrically coupled to the electronic controller and capable of energizing the motor driver, the brake driver, first switch, and second switch.

15. The elevator of claim 13, wherein the first and second switches further include a closed state, wherein in the closed state, the first switch enables the motor driver to energize the motor and the second switch enables the brake driver to energize the braking system.

16. The elevator of claim 12, further includes a safety chain electrically coupled to the electronic controller and capable of providing a signal indicating a malfunction mode to the electronic controller, causing the first and second switches to transition into the open state.

17. The elevator of claim 12, wherein the motor is a permanent magnet motor.

18. A method for controlled stopping an elevator, comprising:

providing a motor capable of generating a counter-electromotive force;

providing a braking system having a disengaged and an engaged position, wherein the braking system moves to the disengaged position upon being energized and moves to the engaged position upon being de-energized;

electrically coupling the motor to the braking system;

creating a braking torque for the elevator from the counterelectromotive force of the motor;

energizing the braking system with the counter-electromotive force of the motor; and releasing the braking system to the engaged position as the counterelectromotive force dissipates into the braking torque for the elevator.

19. The method of claim 18, wherein electrically coupling the motor to the braking system is performed by first and second switches transitioning into an open state, wherein in the open state, the first and second switches have a signal converter in between, the signal converter capable of converting the counter-electromotive force into an acceptable format to be received by the braking system.

20. The method of claim 18, wherein releasing the braking system to the engaged position is performed when the counter-electromotive force is insufficient to energize a brake coil in the braking system.

* * * * *